US006647989B1

(12) United States Patent
De Benedictis

(10) Patent No.: US 6,647,989 B1
(45) Date of Patent: Nov. 18, 2003

(54) HAIR TREATMENT DEVICE AND METHOD

(76) Inventor: Alfredo De Benedictis, 13-15 King Street, Luton Bedfordshire LU1 2DW (GB)

( * ) Notice: Subject to any disclaimer, the term of this patent is extended or adjusted under 35 U.S.C. 154(b) by 0 days.

(21) Appl. No.: 09/937,704

(22) PCT Filed: Mar. 21, 2000

(86) PCT No.: PCT/GB00/01043

§ 371 (c)(1),
(2), (4) Date: Oct. 1, 2001

(87) PCT Pub. No.: WO00/57744

PCT Pub. Date: Oct. 5, 2000

(30) Foreign Application Priority Data

Mar. 30, 1999 (GB) ..... 9907166
Apr. 22, 1999 (GB) ..... 9909107

(51) Int. Cl.[7] ..... A45D 7/00; A45D 6/00

(52) U.S. Cl. ..... 132/210; 132/222; 132/223; 132/273

(58) Field of Search ..... 132/207, 210, 132/211, 222, 223, 224, 55, 245, 269, 270, 273, 274; 219/201, 211

(56) References Cited

U.S. PATENT DOCUMENTS 1,400,637 A * 12/1921 Szkanyi ..... 132/211
1,595,272 A * 8/1926 Weathers ..... 132/269
1,703,005 A * 2/1929 Hewitt ..... 219/529
1,884,305 A * 10/1932 Shelton ..... 132/206
2,125,402 A * 8/1938 Simas ..... 219/222
2,765,798 A * 10/1956 Carvell ..... 132/55
2,775,245 A * 12/1956 Behr ..... 132/273
2,924,228 A * 2/1960 McGee ..... 132/273
3,307,562 A * 3/1967 Corbett et al. ..... 132/245
3,347,248 A * 10/1967 Weitzner ..... 132/252
3,523,542 A * 8/1970 Eisler ..... 132/229
3,566,888 A 3/1971 Bonarigo
3,631,868 A 1/1972 Solomon
3,871,388 A 3/1975 Leoci
4,022,225 A * 5/1977 Kauffman ..... 132/269
4,895,140 A * 1/1990 Bellak ..... 600/39
4,958,648 A * 9/1990 Morey ..... 132/220
5,472,003 A 12/1995 Frame et al.
5,649,541 A * 7/1997 Stuckey ..... 128/880
5,771,906 A 6/1998 De Benedictis
5,878,756 A * 3/1999 Bilodeau ..... 132/274
5,970,991 A * 10/1999 Srivastava ..... 132/274
6,041,791 A * 3/2000 Belmonte et al. ..... 132/222

* cited by examiner

*Primary Examiner*—Eduardo C. Robert
*Assistant Examiner*—David Comstock
(74) *Attorney, Agent, or Firm*—Dykema Gossett PLLC

(57) ABSTRACT

A device for use in hair treatment comprises a tube (10) having a wall constructed of elements (11, 12) extending in a direction inclined to the length of the tube, or a wall constructed of interwoven fibres (11, 12). As a result of its construction when the tube is contracted from an elongate state to a contracted state, the transverse dimension of the tube increases to permit insertion of a tress of hair through the tube. After insertion of the hair through the tube, the tube is extended which causes the transverse dimension to decrease and compress together the hairs of the tress. The tube is then manipulated into a desired form to thereby impart a required form to the tress of hair. The tube may be performed in the desired form and after insertion of the tress of hair is permitted to revert to the desired form. Restraints ($52_1$, $52_2$) may be applied to the tube and hair contained therein and then the tube between the restraints is contracted lengthwise to cause the transverse dimension thereof to increase.

13 Claims, 4 Drawing Sheets

HAIR TREATMENT DEVICE AND METHOD

This invention relates to devices for and methods of treatment of hair and in particular to the imparting of a designed form, for example, a wave or curl to a tress of hair.

According to the invention a device for treatment of a tress of hair including a cylindrical tube open at at least one end is characterised in that said tube is formed such that contraction of the tube lengthwise from a first lengthwise state to a second lengthwise state causes a transverse dimension of said tube to increase from a first dimension to a second dimension; and said tube when in the first lengthwise state is manipulable into or preformed in a determined form to impart a desired form to said tress of hair contained within said tube.

According to a second aspect of the invention a method of treatment of a tress of hair is characterised by the steps of:

inserting the tress of hair into a cylindrical tube while the tube is in a lengthwise contracted state, said tress of hair extending lengthwise through the tube and said tube having a characteristic property such that a transverse dimension of the tube increases as a lengthwise dimension thereof is decreased;

extending the tube from the contracted state; and causing the extended tube containing the tress of hair to assume a determined form to impart a desired formation to the tress of hair contained within the tube.

Figure 1:
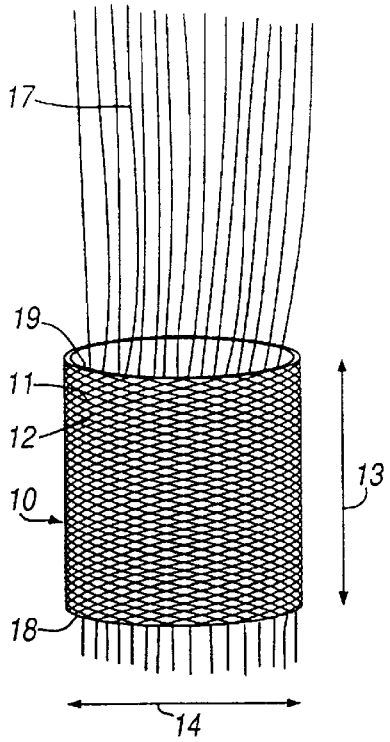
Figure 2:
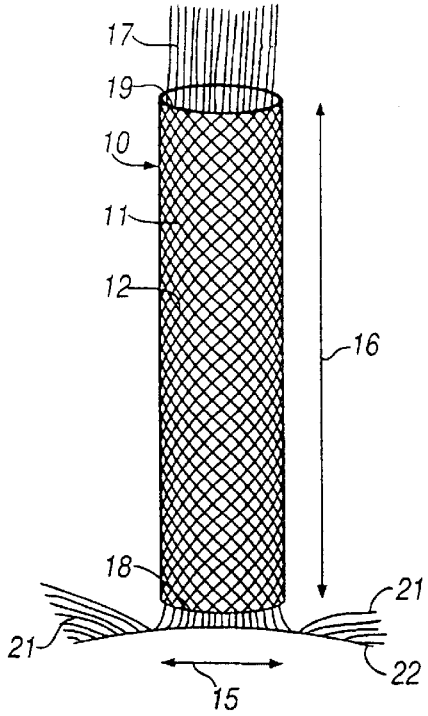
Figure 3:
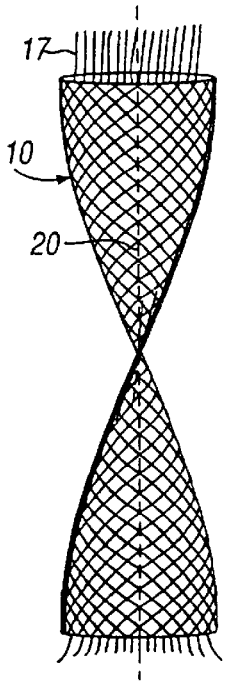
Figure 4:
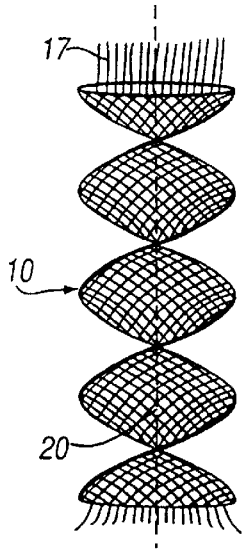
Figure 5:
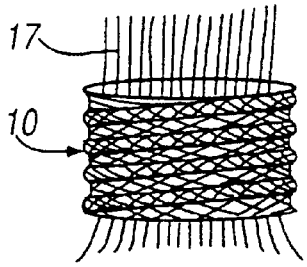
Figure 6:
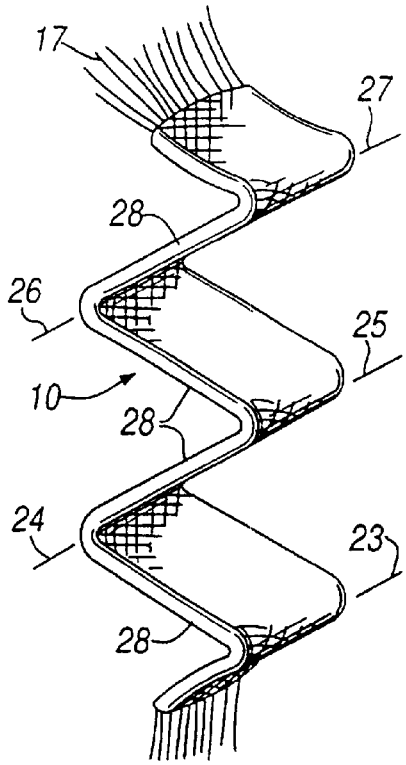
Figure 7:
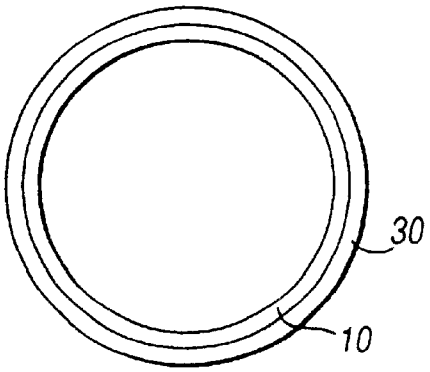
Figure 8:
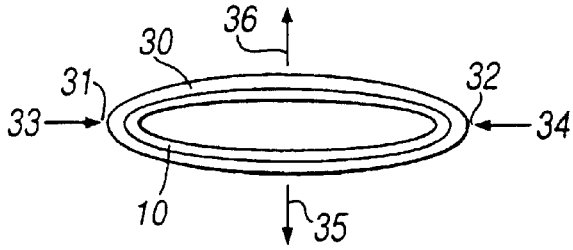
Figure 9:
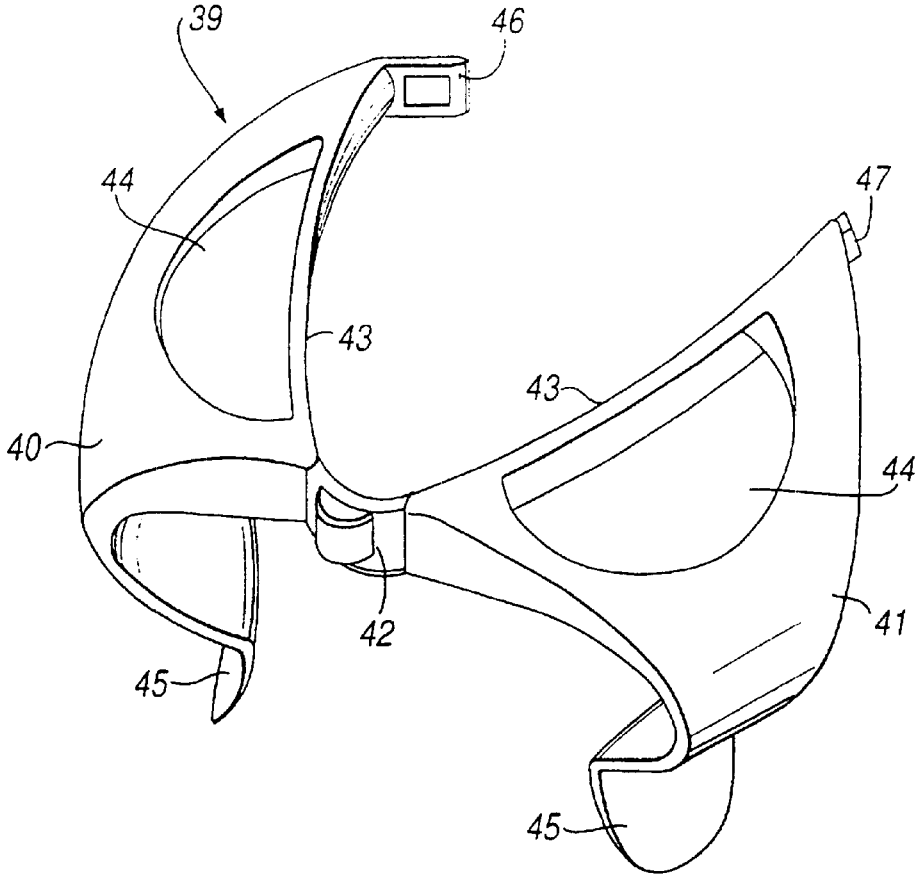
Figure 12:
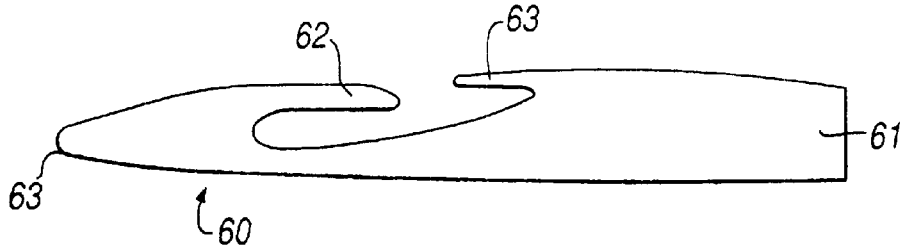
Figure 10:
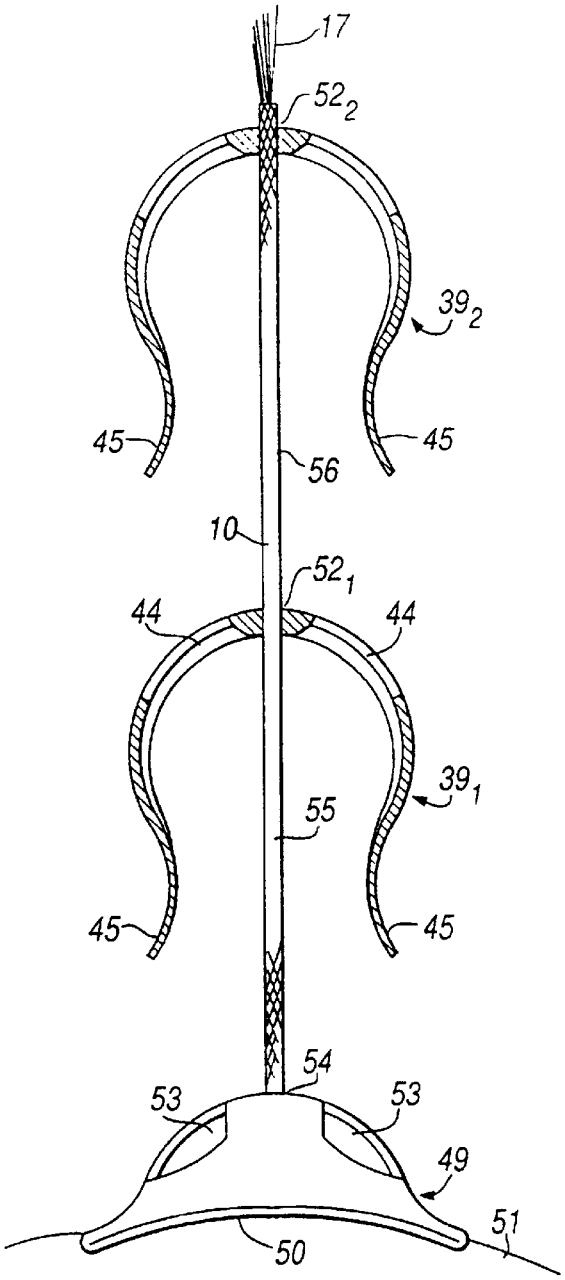
Figure 11:
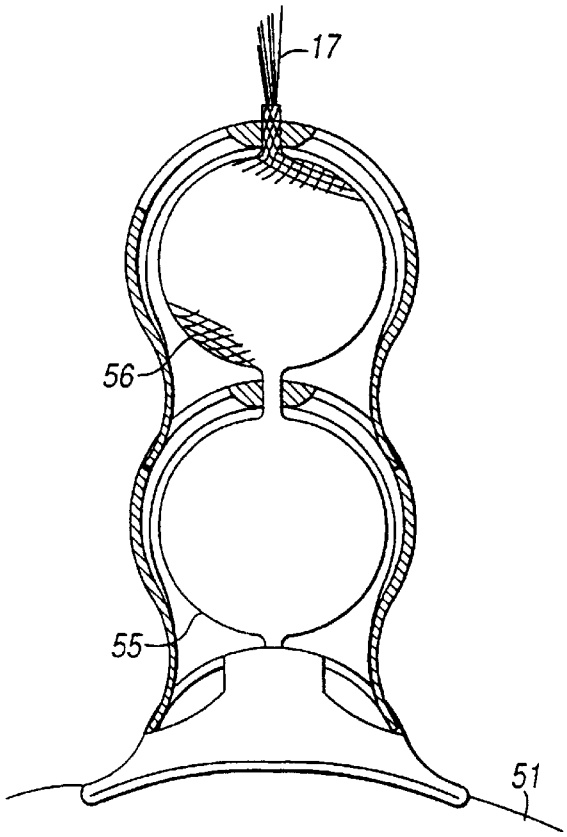

An embodiment of the invention will now be described by way of example with reference to the drawings in which:

FIG. 1 illustrates a tube in a contracted state with a tress of hair extending therethrough, FIG. 2 illustrates the tube extended from the contracted state with the tress of hair extending therethrough, FIG. 3 illustrates an initial twisting of the tube, FIG. 4 illustrates further twisting of the tube, FIG. 5 illustrates the twisted tube compacted lengthwise, FIG. 6 illustrates the tube when bent transversely into a concertina state, FIGS. 7 and 8 illustrate an end of the tube provided with means to engage the end of the tube with a tress of hair contained therein, FIG. 9 illustrates a device for use with the tube to maintain parts of the tube located relative to a tress of hair, FIG. 10 illustrates the device of FIG. 9 in combination with the tube, the tube being in an elongate state, FIG. 11 is similar to FIG. 10 with the tube contracted from the elongate state, and FIG. 12 illustrates a hook for use with the tube.

Referring first to FIG. 1 of the drawings, a generally cylindrical tube 10 has a wall formed of elements comprising interwoven fibres 11, 12 extending at an angle inclined both to a longitudinal dimension 13 and to a transverse dimension 14 of the tube. As a result of this inclination of the elements, the transverse dimension 14 of the tube is greater when the tube is contracted lengthwise to the longitudinal dimension 13 (see FIG. 1) than the transverse dimension 15 (see FIG. 2) of the tube when in an extended state with a longitudinal dimension 16 as shown in FIG. 2. Accordingly when the tube is in a contracted lengthwise state as shown in FIG. 1, the insertion of a tress of hair 17 into the tube through a first open end 18 thereof, through the tube and out through a second open end 19 thereof is facilitated. When the tube is extended from the contracted state to the extended state shown in FIG. 2 the transverse dimension of the tube decreases and the wall of the tube moves radially inwards to compress the hairs of the tress of hair 17 together.

With the tube in the extended state, the tube is manipulated to a determined form so as to impart a desired form to the tress of hair contained in the tube. In one form of manipulation illustrated by FIG. 3, the tube is flattened and is twisted about a longitudinal axis thereof indicated by broken line 20. The twisting of the tube causes the wall of the tube to flatten from a generally circular transverse section as shown in FIGS. 1 and 2 into a flat oval transverse section as shown in FIG. 3 and as a result the tress of hair contained within the tube is caused to assume a generally helical formation. Twisting of the tube may be continued to a selected extent as shown in FIG. 4 so as to impart a desired amount of twist to the helical formation of the tress of hair. Upon twisting the tube to the selected extent, the twisted tube with the tress of hair contained therein may be compacted lengthwise to a desired extent, and for example the twists of the tube may lie closely together as shown in FIG. 5.

The tress of hair is treated with a liquid hair treatment substance to cause the hair to retain the formation imparted thereto as a result of being contained within the tube and by the twisting of the tube. The treatment of the hair with the liquid treatment substance may be effected prior to or after insertion of the hair into the tube and may be effected before or after twisting of the tube. If the liquid treatment substance is applied after insertion of the hair into the tube, the substance may be applied through interstices between the fibres 11, 12. After a time period during which the substance acts on the hair to cause retention of the formation imparted to the hair, the hair is released from the confines of the tube by withdrawal of the tube from the tress of hair. If it is required, heat may be applied to the hair while the tress of hair is contained within the tube prior to withdrawal of the tube from the tress of hair. The heat may be applied from an external device or the tube may be formed with electrically resistive fibres through which an electric current is passed to generate heat in the wall of the tube.

In the drawings, the tress of hair is shown as extending through and beyond the tube. However it is to be understood that the length of the tube relative to the length of the tress of hair may be such that, when the tube is in the extended state shown in FIG. 2, the tress of hair does not extend out of the end 19 of the tube.

In using the tube in the treatment of a tress of hair, the tress of hair 17 is separated from other hair 21 on a scalp 22 and is drawn through the open end 18 into and through the tube 10. The position of the tube 10 along the length of the tress of hair 17 may then be adjusted such that the open end 18 of the tube lies adjacent the root ends of the hair and the scalp 22. However if desired the tube may be located at any position along the length of the tress of hair 17 in order to treat a selected part of the length of the tress.

As described hereinbefore, the tube has a wall formed of elements comprising interwoven fibres 11, 12 extending at an angle inclined both to a longitudinal dimension 13 and a transverse dimension 14 of the tube. While the wall of the tube may conveniently be formed of interwoven fibres 11, 12, the wall of the tube may be formed in a different manner not using interwoven fibres. For example instead of fibres which are interwoven, the wall may be formed of fibres or other elements which extend across one another and are bonded together at locations at which the fibres or other elements cross one another. The wall of the tube may be formed by bonding fibres or other elements together or the fibres or other elements may be formed integrally in the required bonded relationship for example by a moulding process.

It will be appreciated that as the tube is contracted or extended the angle of inclination of the elements forming the wall of the tube changes and causes a corresponding increase or decrease respectively of the transverse dimension of the tube.

The elements forming the wall of the tube are flexible and may be of synthetic plastics material or may be of metal. If desired the elements may be elastic and resiliently extendible. When the wall of the tube is a mesh formed by fibres or other elements bonded together or formed integrally it will be appreciated that the elements or the interconnections between the elements or both the elements and the interconnections therebetween are sufficiently flexible to permit the required contraction and extension of the tube.

While the tube has been described hereinbefore as being of woven or mesh construction, other constructions that result in the transverse dimension of the tube increasing when the tube is contracted from its normal uncontracted state and permit the tube to be manipulated in the desired manner may be utilised.

It will be appreciated that after twisting of the tube, the tube needs to be retained twisted while the treatment substance acts on the hair. Accordingly it is convenient to mount the tube within a holder comprising a first structure secured to the end 18 of the tube and a second structure secured to the end 19 of the tube. The second structure is manually displaceable toward and away from the first structure to permit the tube to be contracted and extended lengthwise respectively. Also the second structure is rotatable relative to the first structure whereby the tube and the tress of hair contained therein may be twisted as described hereinbefore. Preferably means are provided to locate the second structure relative to the first structure in a first position such that the tube is contracted and not twisted and in a second position such that the tube is retained in a twisted condition. Where it is desired to compact the twisted tube containing the tress of hair as described hereinbefore, the second position of the second structure may be the same as the first position but the second structure will have been subjected to at least one rotation to twist the tube. The structure secured to the ends of the tube may be of different diameters whereby one structure may be enter the other structure in a telescoping manner when the tube is urged into the contracted lengthwise state. Also if desired the holder may include additional structures intermediate the first and second structures, and all of the structures may then be constructed to telescope together.

In an alternative manipulation of the tube illustrated in FIG. 6, after insertion of the tress of hair and extension of the tube to its uncontracted state, the tube is flattened and then is subjected to bending about a plurality of axes 23–27 extending transversely of the tube and spaced apart along the length of the tube in at least one direction so that parts 28 of the length of the tube lie adjacent one another in a concertina fashion. The bending of the tube imparts a waved form to the tress of hair contained within the tube. The sharpness of the bends may be chosen such as to produce a desired formation to the tress of hair 17 contained within the tube. The axes 23–27 about which the tube containing the tress of hair is bent may extend perpendicular to the length of the tube and or may be inclined to the length of the tube.

As described hereinbefore, the tube has been described as being of generally circular cross-section and, after insertion of the tress of hair into the tube, the tube is flattened and then manipulated to a final form to impart a desired formation to the tress of hair contained in the tube. However if desired the tube may be preformed to the required final form. Thus where it is desired that the tube has a flattened twisted final form as illustrated in FIGS. 3 or 4, the tube is preformed to a twisted flattened form. Alternatively where it is desired that the tube has a concertina final form as illustrated in FIG. 6, the tube is preformed to this concertina form. Accordingly when it is desired to insert a tress of hair into the tube, initially the preformed tube is deformed to extend substantially linearly and opened into an approximately circular cross section to permit insertion of the tress of hair. Then the tube is released whereupon the tube reverts to the required preformed final form thereby imparting the required formation to the tress of hair contained in the tube.

To facilitate insertion of the tress of hair into the tube 10, as shown in FIGS. 7 and 8, a resilient ring shaped element 30 may be secured respectively to each end of the tube. Normally the ring element is of oval form as shown in FIG. 8 so that the tube 10 has an oval cross section. When it is desired to insert a tress of hair into the tube, the ring element 30 is held between thumb and finger positioned at 31, 32 so that when manual pressure is applied as indicated by arrows 33, 34, the ring opens in the direction of arrows 35, 36 to a circular form as shown in FIG. 7. Upon release of manual pressure on the ring after the tress of hair has been inserted into the tube, the ring reverts to the oval form as shown in FIG. 8.

In yet a further different manipulation of the tube, after insertion of the tress of hair and extension of the tube to its uncontracted state, the tube is subjected to restraint in a transverse direction at one or more locations along the length of the tube to prevent or at least restrict increase of the transverse dimension of the tube when the tube is contracted lengthwise. The tube is then manipulated by contracting the tube lengthwise and thereby causing the wall of the tube to balloon out only in positions where it is not subjected to the restraint. As a result the hairs of the tress of hair are held in close proximity in locations corresponding to those locations at which transverse restraint is applied to the tube and are caused to be confined within lengthwise contracted portions of the tube which bow out to provide regions of increased transverse dimension at each side of the location at which the transverse restraint is applied. Manipulation of the tube in this manner is illustrated in FIGS. 10 and 11 using a restraining device 39 illustrated in FIG. 9.

Referring first to FIG. 9, the restraining device 39 comprises two members 40, 41 hinged together at 42. Each member 40, 41 includes a jaw element 43. Each member 40, 41 is of part spherical form and has an aperture 44 located in an upper part (as seen in FIG. 9) thereof adjacent the jaw element 43. The lower part of each member 40, 41 is provided with a support leg 45. The arrangement of the apertures 44 and support legs 45 is such that restraining devices can be stacked on one another with the legs 45 engaging in the apertures 43 of an adjacent restraining device thereby to locate the restraining devices relative to one another. The member 40 is provided, remote from the hinge 42, with a catch 46. The catch 46 is engageable with a projection 47 on the member 41, when the members 40, 41 are closed together, to maintain the members 40, 41 in the closed position.

FIGS. 10 and 11 illustrate use of two restraining devices $\mathbf{39}_1$, $\mathbf{39}_2$ together with a scalp device 49 with a tube 10. The scalp device is of similar construction to the restraining devices 39 in that it two jaw elements hinged together and is provided with apertures 53 to be engaged by legs of a restraining element. However instead of support legs, the scalp device 49 is formed at 50 to seat on a scalp 51. When a tress of hair 17 has been inserted into and through the tube 10 with one end of the tube located adjacent the scalp 51, the scalp device 49 is seated on the scalp and is closed to clamp the tube, at a location 54 adjacent the end of the tube, and the hair contained therein between the jaw elements of the scalp device. The tube is extended to an elongate state as shown in FIG. 10. The restraining devices $\mathbf{39}_1$ and $\mathbf{39}_2$ are located spaced along the length of the tube 10 and then are closed to clamp the tube and the hair contained therein at locations $\mathbf{52}_1$ and $\mathbf{52}_2$ respectively. The clamping of the tube and hair by means of the restraining devices $\mathbf{39}_1$, $\mathbf{39}_2$ and by the scalp device 49 is effective to prevent displacement in a direction lengthwise of the tube between the hair and the tube at the locations at which the clamping is effected. The restraining devices $\mathbf{39}_1$ and $\mathbf{39}_2$ are then displaced manually toward the scalp device to a position as shown in FIG. 11 in which the legs 45 of the device $\mathbf{39}_1$ engage in apertures 53 of the scalp device 49 and the legs 45 of the device $\mathbf{39}_2$ engage in the apertures 44 of the device $\mathbf{39}_1$. As a result of this displacement of the restraining devices, portions 55, 56 of the tube extending between the locations 54, $\mathbf{52}_1$, and between $\mathbf{52}_1$, $\mathbf{52}_2$ respectively are contracted in length and as a result these portions of the tube increase in diameter and balloon outwards as shown in FIG. 11. It will be appreciated that the displacement of the restraining devices not only causes the portions 55, 56 of the tube to be contracted lengthwise but also causes the hair contained in the tube to be contained in a decreased length of tube of increased diameter. Hence, at the locations 54, $\mathbf{52}_1$, $\mathbf{52}_2$ the hair is held closely in juxtaposition but between these locations the hairs of the tress are free to move outwards relative to one another and to assume a random form.

The jaw elements of the scalp device 49 and of the restraining devices may be provided with means to enhance the effectiveness of the clamping of the tube and the hair contained therein to prevent displacement in a direction lengthwise of tube of the hair, the tube and the restraining device or scalp device relative to one another. The means to enhance the effectiveness of the clamping may comprise one or more spikes or pins on the jaw elements which the enter interstices between the fibres or other elements forming the tube and enter between hairs of the tress of hair contained in the tube.

The scalp device 49 and the restraining devices $\mathbf{39}_1$, $\mathbf{39}_2$ may be separate from the tube 10 and applied to the tube during treatment of the tress of hair or is desired on or more of the devices may be secured to the tube at a desired location along the length of the tube.

While examples of determined forms into which the tube may be manipulated or preformed have been disclosed hereinbefore it will be appreciated that the tube may be manipulated into or be preformed to have other determined forms to impart a desired formation to a tress of hair. Accordingly it is to be understood that the invention is not limited to the specific examples that have been disclosed hereinbefore.

Insertion of the tress of hair into the tube is conveniently accomplished by use of a hook on an elongate handle. The hook is passed through the tube until is emerges and then is engaged with the tress of hair. The hook then is withdrawn through the tube thereby drawing the tress of hair into and through the tube. If the tube has been preformed to a determined final form, passage of the hook through the tube will straighten the tube and facilitate subsequent drawing of the tress of hair into and through the tube. However it will be appreciated that the hook should have a form that permits passage of the hook through the tube both during insertion of the hook and during withdrawal of the hook without snagging the mesh of the tube. Accordingly it is preferred to provide a hook having a form illustrated in FIG. 12. The hook 60 is on an elongate handle 61, of which only a part is shown, and has a first tooth 62 extending backwards from a front end 63 of the hook. The first tooth 62 is shaped such that a free end of the tooth extends inwards relative to the outer profile of the hook. In use, a tress of hair is caught under the first tooth to draw the tress of hair into and through the tube. However because the free end of the tooth extends inwardly relative to the outer profile of the hook, the free end is spaced from the mesh of the tube and therefore does not snag the mesh. If desired a second tooth 63 may be provided.

What is claimed is:

1. A device for treatment of a tress of hair including a lengthwise contractible cylindrical tube open at at least one end for containing the tress of hair, said tube being formed such that contraction of the tube lengthwise from a first lengthwise state to a second lengthwise state causes a transverse dimension of said tube to increase from a first dimension to a second dimension, the tube being resiliently spring biased toward a preformed state in which the tube is one of the flattened and twisted about a longitudinal axis thereof and bent about at least one axis extending transversely to the longitudinal axis so that the cylindrical shape of the tube is distorted so as; to impart a desired form to said tress of hair contained within said tube during use, the tube being resiliently manipulable from said preformed sate into said cylindrical shape.

2. A device as claimed in claim 1, wherein the tube has a wall comprising interwoven fibres inclined to the length of the tube.

3. A device as claimed in claim 1, wherein the tube has a wall comprising elements interconnected in a mesh formation, said elements being inclined to the length of the tube.

4. A device as claimed in claim 1, wherein in the determined form the tube is of oval cross section and has a twist about a lengthwise axis of the tube.

5. A device as claimed in claim 1, further comprising at least one electrically resistive element extending through a wall of the tube and heatable by passage of electric current.

6. Apparatus for treatment of a tress of hair including a lengthwise contractible cylindrical tube open at at least one end and being formed such that contraction thereof lengthwise from a first lengthwise state to a second lengthwise state causes a transverse dimension of the tube to increase from a first dimension to a second dimension, said tube when in the first lengthwise state being manually preformable into a determined form to impart a desired form to the tress of hair contained within the tube, and further including first and second means for locating respectively at desired first and second locations at a first spacing along the length of the tube and operable to prevent at each of said first and second locations lengthwise displacement of a tress of hair relative to the tube, and means to secure said first and second means relative to one another such that the first and second locations are spaced at a second spacing less than said first spacing thereby causing the tube between said locations to increase to said second transverse dimension.

7. Apparatus as claimed in claim 6, wherein the first and second means each include a pair of jaw elements hinged together and movable into a closed position in which the tube and hair contained therein are restrained between and by the jaw elements of the pair.

8. Apparatus as claimed in claim 6, wherein the first means is engageable with the second means to secure the first and second means relative to one another.

9. A method of treatment of a tress of hair, comprising the steps of: inserting the tress of hair into a lengthwise contractible cylindrical tube while the tube is in a lengthwise contracted state, said tress of hair extending lengthwise through the tube and said tube having a characteristic property such that a transverse dimension of the tube increases as a lengthwise dimension thereof is decreased; extending the tube from the contracted state; and causing the extended tube containing the tress of hair to assume a determined form to impart a desired formation to the tress of hair contained with the tube.

10. A method as claimed in claim 9, wherein the extended tube containing the tress of hair is caused to assume the determined form by manipulating the tube to the determined form.

11. A method as claimed in claim 9, wherein the extended tube is preformed to the determined form and the tube is deformed from the determined form in the step of inserting the tress of hair to extend through the tube, and permitting the tube containing the tress of hair to return to the determined form after insertion of the tress of hair into the tube.

12. A method as claimed in claim 9, including the step, after insertion of the tress of hair into the tube and with the tube extended, of applying restraint to the tube at spaced locations to prevent relative displacement of the hair and the tube in a direction lengthwise of the tube at said spaced locations and then decreasing the spacing of the locations to contract the tube lengthwise between the spaced locations.

13. A hair engaging hook constructed for use with a hair treatment device including a lengthwise contractible cylindrical tube open at at least one end, said tube being formed such that contraction of the tube lengthwise from a first lengthwise state to a second lengthwise state causes a transverse dimension of said tube to increase from a first dimension to a second dimension; and said tube when in the first lengthwise state being manually preformable into a determined form to impart a desired form to said tress of hair contained within said tube, including a hook member having an outer profile and a hair engaging tooth having a free end extending inwards from the outer profile.

* * * * *